US007722127B2

(12) United States Patent
Hall

(10) Patent No.: US 7,722,127 B2
(45) **Date of Patent: *May 25, 2010**

(54) PICK SHANK IN AXIAL TENSION

(75) Inventor: David R. Hall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 76 days.

This patent is subject to a terminal disclaimer.

(21) Appl. No.: 11/829,761

(22) Filed: Jul. 27, 2007

(65) Prior Publication Data

US 2008/0036277 A1 Feb. 14, 2008

Related U.S. Application Data

(63) Continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 11/829,761, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21C 35/18* (2006.01)

(52) U.S. Cl. ..... 299/106; 299/104; 299/107

(58) Field of Classification Search ..... 299/106, 299/107, 104, 105
See application file for complete search history.

(56) References Cited

U.S. PATENT DOCUMENTS 2,004,315 A 6/1935 Fean (Continued)

*Primary Examiner*—John Kreck
(74) *Attorney, Agent, or Firm*—Holme Roberts & Owen LLP

(57) ABSTRACT

In one aspect of the present invention, a degradation assembly comprises a holder attached to a driving mechanism and comprises a longitudinal central bore. The bore comprises an opening at a distal end from the driving mechanism. A pick comprising a body intermediate a shank and an impact tip is connected to the holder, the shank being disposed in the central bore of the holder and the body extending from the opening of the bore. A tensioning mechanism is disposed within the bore and is adapted to put the shank in axial tension.

19 Claims, 9 Drawing Sheets

U.S. PATENT DOCUMENTS 3,746,396 A 7/1973 Radd
3,767,266 A * 10/1973 Krekeler ..... 299/107
3,807,804 A 4/1974 Kniff
3,932,952 A 1/1976 Helton
3,945,681 A 3/1976 White
4,005,914 A 2/1977 Newman
4,006,936 A 2/1977 Crabiel
4,201,421 A 5/1980 Den Besten
4,277,106 A 7/1981 Sahley
4,484,644 A 11/1984 Cook
4,489,986 A 12/1984 Dziak
4,537,448 A * 8/1985 Ketterer ..... 299/81.2
4,678,237 A 7/1987 Collin
4,682,987 A 7/1987 Brady
4,688,856 A 8/1987 Elfgen
4,725,098 A 2/1988 Beach
4,729,603 A 3/1988 Elfgen
4,765,686 A 8/1988 Adams
4,765,687 A 8/1988 Parrott
4,944,559 A 7/1990 Sionnet
5,011,515 A 4/1991 Frushour
5,018,793 A * 5/1991 Den Besten ..... 299/107
5,154,245 A 10/1992 Waldenstrom
5,251,964 A 10/1993 Ojanen
5,332,348 A 7/1994 Lemelson
5,374,111 A * 12/1994 Den Besten et al. ..... 299/106
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,823,632 A 10/1998 Burkett
5,845,547 A 12/1998 Sollami
5,875,862 A 3/1999 Jurewicz
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,056,911 A 5/2000 Griffin
6,113,195 A 9/2000 Mercier
6,170,917 B1 1/2001 Heinrich
6,196,636 B1 3/2001 Mills
6,196,910 B1 3/2001 Johnson
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,499,547 B2 12/2002 Scott
6,517,902 B2 2/2003 Drake
6,585,326 B2 7/2003 Sollami
6,685,273 B1 2/2004 Sollami
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,824,225 B2 11/2004 Stiffler
6,889,890 B2 5/2005 Yamazaki
6,966,611 B1 11/2005 Sollami
6,994,404 B1 2/2006 Sollami
7,204,560 B2 4/2007 Mercier
7,387,345 B2 * 6/2008 Hall et al. ..... 299/79.1
7,390,066 B2 * 6/2008 Hall et al. ..... 299/81.1
7,413,258 B2 * 8/2008 Hall et al. ..... 299/111
2003/0047985 A1 * 3/2003 Stiffler ..... 299/102
2003/0209366 A1 11/2003 McAlvain
2004/0026983 A1 2/2004 McAlvain
2004/0065484 A1 4/2004 McAlvain
2006/0237236 A1 10/2006 Sreshta
2006/0261663 A1 * 11/2006 Sollami ..... 299/104

* cited by examiner

PICK SHANK IN AXIAL TENSION

CROSS REFERENCE TO RELATED APPLICATIONS

This application is a continuation-in-part of U.S. patent application Ser. No. 11/773,271 which was filed on Jul. 3, 2007. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 which was filed on Apr. 30, 2007 now U.S. Pat. No. 7,475,948. U.S. patent application Ser. No. 11/742,304 is a continuation of U.S. patent application Ser. No. 11/742,261 which was filed on Apr. 30, 2007 now U.S. Pat. No. 7,469,971. U.S. patent application Ser. No. 11/742,261 is a continuation-in-part of U.S. patent application Ser. No. 11/464,008 which was filed on Aug. 11, 2006 now U.S. Pat. No. 7,338,135. U.S. patent application Ser. No. 11/464,008 is a continuation-in-part of U.S. patent application Ser. No. 11/463,998 which was filed on Aug. 11, 2006 now U.S. Pat. No. 7,384,105. U.S. patent application Ser. No. 11/463,998 is a continuation-in-part of U.S. patent application Ser. No. 11/463,990 which was filed on Aug. 11, 2006 now U.S. Pat. No. 7,320,505. U.S. patent application Ser. No. 11/463,990 is a continuation-in-part of U.S. patent application Ser. No. 11/463,975 which was filed on Aug. 11, 2006 now U.S. Pat. No. 7,445,294. U.S. patent application Ser. No. 11/463,975 is a continuation-in-part of U.S. patent application Ser. No. 11/463,962 which was filed on Aug. 11, 2006 now U.S. Pat. No. 7,413,256. U.S. patent application Ser. No. 11/463,962 is a continuation-in-part of U.S. patent application Ser. No. 11/463,953, which was also filed on Aug. 11, 2006 now U.S. Pat. No. 7,464,993. The present application is also a continuation-in-part of U.S. patent application Ser. No. 11/695,672 which was filed on Apr. 3, 2007 now U.S. Pat. No. 7,396,086. U.S. patent application Ser. No. 11/695,672 is a continuation-in-part of U.S. patent application Ser. No. 11/686,831 filed on Mar. 15, 2007 now U.S. Pat. No. 7,464,993. All of these applications are herein incorporated by reference for all that they contain.

BACKGROUND OF THE INVENTION

In the asphalt industry, pavement may be degraded using attack picks, and in the mining industry, attack picks may be used to break minerals and rocks. Attack picks may also be used when excavating large amounts of hard materials. In asphalt recycling, often, a drum supporting an array of attack picks disposed within holders attached, together making up a degradation assembly, may be rotated and moved so that the attack picks engage a paved surface causing the picks and/or holders to wear.

U.S. Pat. No. 4,274,678 to Herridge, which is herein incorporated by reference for all that it contains, discloses a mineral mining pick boss having a socket therein for the reception of a shank of a mineral mining pick and a locking arrangement for retaining the shank, the locking arrangement comprising a plug received in a bore extending through the boss transversely of the socket the arrangement being such that the bore intersects the socket, the plug comprising a body of a resilient material (e.g. neoprene) having bonded into the periphery thereof at spaced locations a plurality of metallic members one of which protrudes from the bore into the socket for frictional engagement with the shank of the tool so as to retain the tool in position, the other(s) of the metallic members being disposed within the bore, and the arrangement of the metallic members being such that the plug may be removed from the bore, rotated and re-inserted to change the metallic member which protrudes into the socket.

U.S. Pat. No. 4,484,783 to Emmerich, which is herein incorporated by reference for all that it contains, discloses a mining bit to be mounted for rotation in a bore of a support block or on a drill steel having a retention configuration opposite the working end. A bit shank is formed opposite the working end. A bit shank is formed with an abutment flange at the insertion end and a recess adjacent said flange to receive flexed resilient fingers of a resilient retention ring during insertion of said ring in said bore. A fulcrum land supports an un-split end of said ring. The resilient fingers carry an annular bulge projection which engages an annular recess in a support bore. The ring can extend the length of the retention shank to serve as a wear sleeve. With a drill steel, the retention ring is mounted on an extending insert to cooperate with a female recess in a hollow bit.

U.S. Pat. No. 6,382,733 B1 to Parrott, which is herein incorporated by reference for all that it contains, discloses a mounting member, for a mining cutting apparatus, which has an enlarged head incorporating an annular seating shoulder, whilst a circular section pin extends integrally from the head and is adapted to be received in a circular section socket of a pick box and to be retained therein, a circular groove being provided intermediate the ends of the pins to receive a fluid sealing member, with a first portion of the pin being of such diameter that, in use, it is an interference fit within a pick box socket. The invention also includes a pick box; a mounting member and a pick box combination; a drum for a mineral cutting apparatus; mineral cutting apparatus; a road planning machine; a mining machine, and a tunneling machine.

Examples of degradation assemblies from the prior art are disclosed in U.S. Pat. No. 6,863,352 B2 to Sollami, U.S. Pat. No. 5,392,870 to Clapham et al., U.S. Pat. No. 4,537,448 to Ketterer, U.S. Pat. No. 3,397,013 to Krekeler, U.S. Pat. No. 4,575,156 to Hunter et al., U.S. Pat. No. 3,796,464 to Hansen et al., U.S. Pat. No. 4,678,238 to Emmerich, which are all herein incorporated by reference for all they contain.

BRIEF SUMMARY OF THE INVENTION

In one aspect of the present invention, a degradation assembly comprises a holder attached to a driving mechanism and comprises a longitudinal central bore. The bore comprises an opening at a distal end from the driving mechanism. A pick comprising a body intermediate a shank and an impact tip is connected to the holder, the shank being disposed in the central bore of the holder and the body extending from the opening of the bore. A tensioning mechanism is disposed within the bore and is adapted to put the shank in axial tension.

In some embodiments, a portion of the central bore may have an expanded diameter. A tapered portion of the central bore may be formed intermediate the opening and the expanded diameter portion and may taper out from a center axis of the bore towards the expanded diameter portion. A reduced diameter portion of the shank may be disposed intermediate the pick body and a bottom end of the shank. A spring may be disposed around the reduced diameter portion of the shank and once the shank with the spring is disposed in the bore the spring may engage the tapered portion inducing axial tension in the shank.

A washer may be disposed intermediate the body and the holder. The holder may have a knurled interface that engages the washer preventing the washer from rotating about the center axis. The pick may be adapted to rotate about its central axis.

The body may comprise a conical carbide bolster with a tapered recess. The shank may have a tapered end opposing the bottom end adapted to fit in the tapered recess.

The holder may comprise a lubricant reservoir adapted to apply a lubricant to the shank. The lubricant reservoir may be pressurized and the lubricant reservoir may comprise a filling port. The lubricant reservoir may be adapted to hydraulically disassemble the degradation assembly. The lubricant reservoir may be disposed within the driving mechanism.

A seal assembly may be proximate the opening and disposed intermediate the pick and the holder. The seal assembly may comprise an o-ring partially disposed in a reentrant proximate a junction of the shank and the body. The seal assembly may also comprise an o-ring disposed at the distal end of the holder and which may control the movement of a lubricant.

The holder may comprise a block and/or extension element. The degradation assembly may be part of an asphalt milling machine, a trenching machine, a coal mining machine, or combinations thereof.

DETAILED DESCRIPTION OF THE INVENTION AND THE PREFERRED EMBODIMENT

Figure 1:
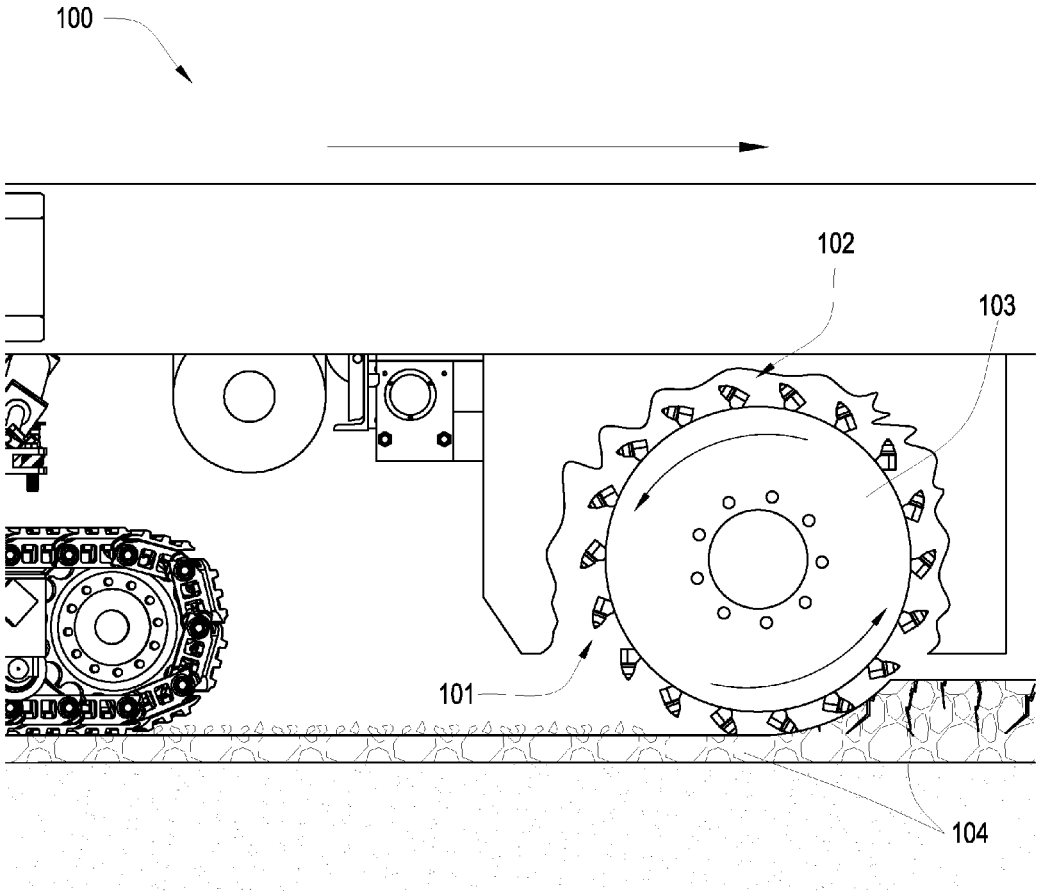
FIG. 1 is a cross-sectional diagram of an embodiment of a plurality of degradation assemblies on a rotating drum attached to a motor vehicle.

FIG. 1 is a cross-sectional diagram of an embodiment of at least one pick 101 attached to a rotating drum 103 connected to the underside of a pavement recycling machine 100. The recycling machine 100 may be a cold planer used to degrade man-made formations such as pavement 104 prior to the placement of a new layer of pavement. Picks 101 may be attached to the drum 103 bringing the picks 101 into engagement with the formation. A holder 102 is attached to the rotating drum 103, and the pick 101 is inserted into the holder 102. The holder 102 may hold the pick 101 at an angle offset from the direction of rotation, such that the pick 101 engages the pavement at a preferential angle. Collectively, the pick 101, the holder 102, and the drum 103 may comprise a degradation assembly.

Figure 2:
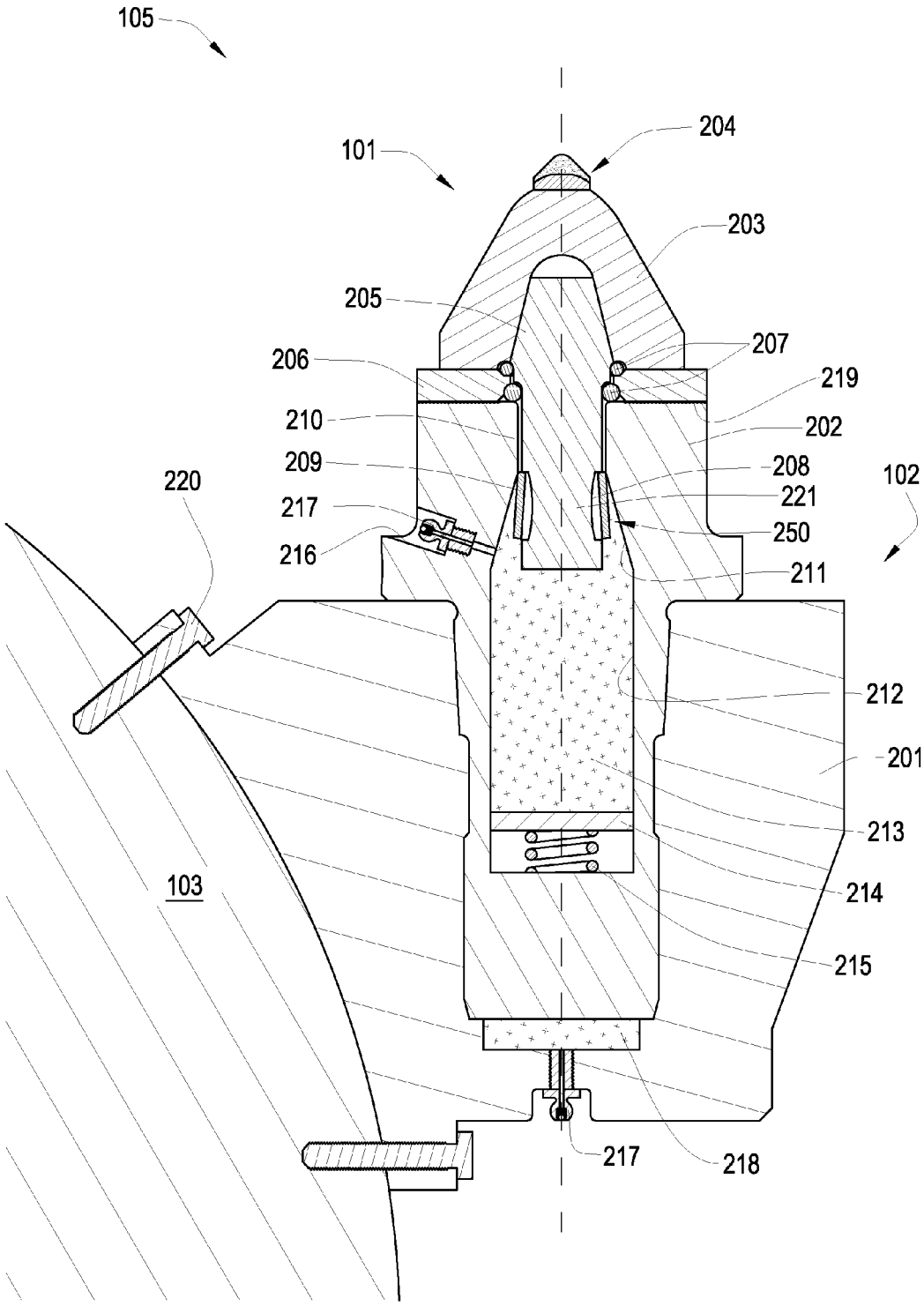
FIG. 2 is a cross-sectional diagram of an embodiment of a degradation assembly.

Referring to FIG. 2, an embodiment of the degradation assembly 105 may comprise a holder 102, a drum 103, and a pick 101; the holder 102 comprises a block 201 and an extension 202. The block 201 is attached directly to the drum 103 by bolts 220. In some embodiments, the block is secured to the drum by a weld. A recess is formed in the block 201 adapted to receive and retain the extension 202. A hydraulic reservoir 218 containing a fluid is disposed intermediate the block 201 and the extension 202. A filling port 217 adjacent to the hydraulic reservoir 218 enables outside access to the hydraulic reservoir 218.

The extension 202 comprises a central bore 210; the central bore 210 comprising an opening at a distal end of the extension 202, and a closed end opposing the opening of the bore 210. A portion 211 of the bore tapers out and away from the central axis. The tapered portion 211 of the bore may taper into an expanded diameter portion 212 of the central bore 210. The expanded diameter 212 portion is located proximate the closed end of the bore 210.

The pick 101 may have a tip 204 comprising a diamond tip bonded to a cemented metal carbide substrate at a non-planar interface. The tip 204 may be bonded to a pick body comprising a cemented metal carbide bolster 203. A tapered recess is formed in the end of the carbide bolster 203 opposing the tip 204. A steel shank 221 has a tapered interface 205 adapted to fit in the tapered recess connecting the carbide body 203 and the steel shank 221.

The steel shank 221 may have a reduced diameter portion 208 disposed intermediate the carbide body 203 and the opposing end of the shank 221. A tensioning mechanism 250 comprising a radially expandable spring 209 is disposed around the reduced diameter portion 208 such that it may not slideably move along the length of the shank 221 beyond the reduced diameter portion 208. The outermost diameter of the spring 209 is larger than the diameter of the shank 221. Compressed, the spring 209 may have a diameter less than or equal to the diameter of the shank 221.

The pick 101 is connected to the extension 202 by placing the shank 221 into the central bore 210; the spring 209 is compressed as it passes the opening of the bore 210. As the shank 221 reaches the tapered portion 211 of the bore 210 the spring 209 expands in diameter and pulls the pick 101 downward against the extension 202. The reduced diameter portion 208 of the shank 221 and the spring 209 never reach the expanded diameter portion 212 of the bore 210 yet remain in the tapered portion 211 of the bore 210. Because the spring 209 is adapted to expand in diameter as the bore 210 diameter increase, the spring 209 will continue to induce an axial tensional force in the shank 221 so long as the spring 209 remains in the tapered portion 211 of the bore 210. The axial tensional force in the shank 221 maintains the connection of the pick 101 to the extension 202. The pick 101 may be rotatable while connected to the extension 202.

A washer 206 may be disposed intermediate the pick body 203 and the extension 202. The extension 202 may have a knurled interface 219 that engages the washer 206 preventing the washer 206 to rotate about the center axis without inhibiting the rotatability of the pick 101. In some embodiments, the tension exerted on the pick is sufficient enough to substantially rotationally fix the washer against the holder, even without knurling, while still allowing the pick to rotate.

The bore may also contain a lubricant reservoir 213 that may supply lubricant to the shank 221 assisting the rotatability of the pick 101 by reducing friction. A seal assembly proximate the opening of the bore 210 and disposed intermediate the pick 101 and the extension 202 may comprise one o-ring 207 partially disposed in a reentrant proximate a junction of the shank 221 and the body 203. The seal assembly may also comprise another o-ring 207 disposed at the distal end of the extension 202 and control the movement of the lubricant as it lubricates the shank 221 and pick 101. A filling port 217 adjacent to the lubricant reservoir 213 enables outside access to the lubricant reservoir 213. The filling port 217 may comprise a bore 216 adapted to protect the filling port 217 while the degradation assembly 105 is in use. The lubricant reservoir 213 may also comprise a plunger 214 and a spring 215 to apply continual pressure on the lubricant.

Figure 3:
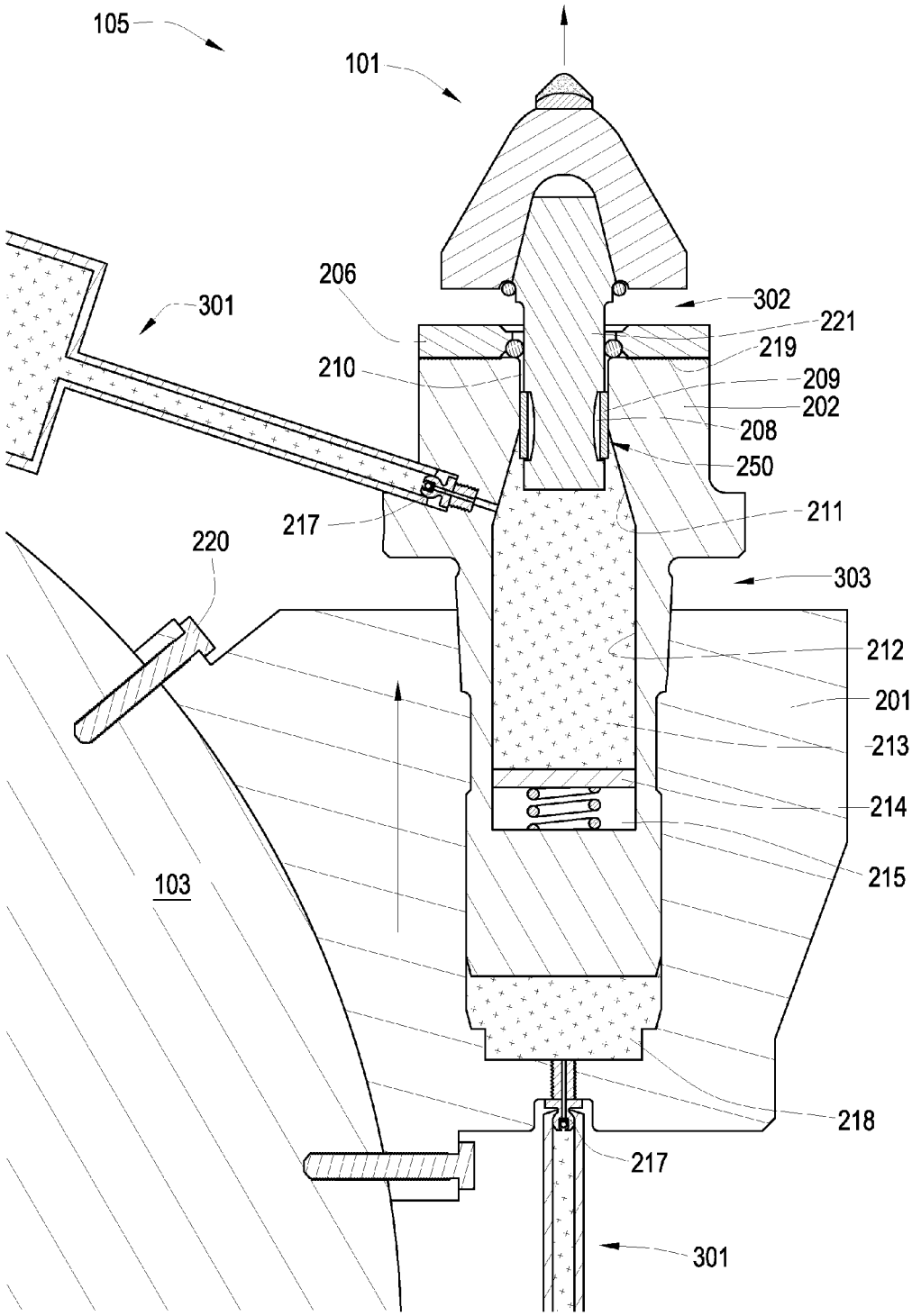
FIG. 3 is a cross-sectional diagram of another embodiment of a degradation assembly.

Referring now to FIG. 3 additional lubricant 301 may be introduced to the lubricant reservoir 213 through the filling port 217 when the lubricant reservoir 213 runs out of lubricant. Additional lubricant 301 may also be added to the lubricant supply of the lubricant reservoir 213 through the filling port 217 to completely remove the shank 221 hydraulically from the bore 210. Additional lubricant 301 may also be added to the lubricant supply of the lubricant reservoir 213 through the filling port 217 to partially remove the shank 221 hydraulically from the bore 210 creating a gap 302 intermediate the pick 101 and extension 202. A tool may then be inserted into the gap 302 to remove the shank 221 from the bore 210 by prying or pulling.

Additional fluid 301 may be added to the fluid supply of the hydraulic reservoir 218 through the filling port 217 to completely remove the extension 202 hydraulically from the block 201. Additional fluid 301 may be added to the fluid supply of the hydraulic reservoir 218 through the filling port 217 to partially remove the extension 202 hydraulically from the block 201 creating a gap 303. A tool may then be inserted into the gap 303 to remove the extension 202 from the block 201 by prying or pulling.

Figure 4:
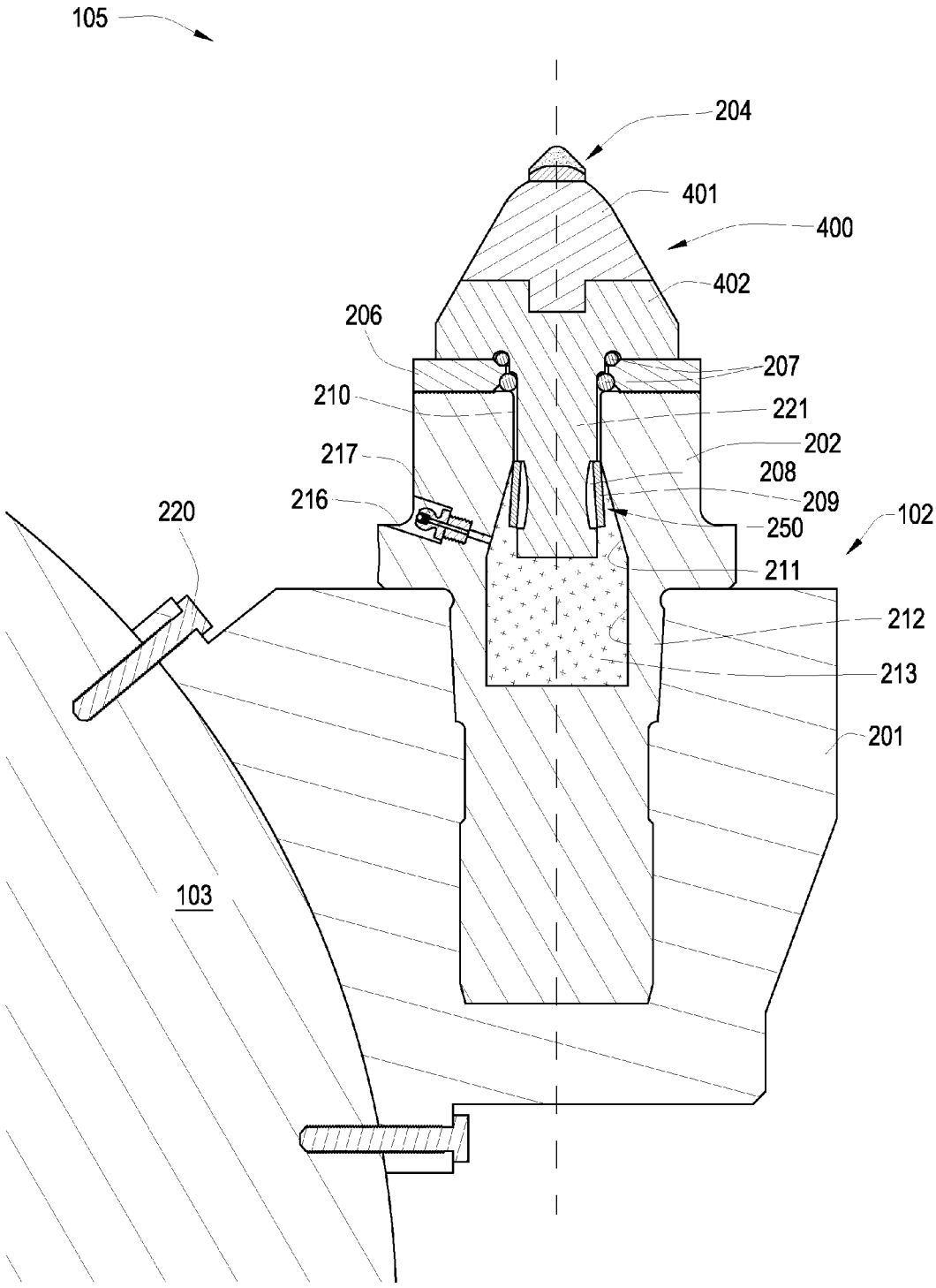
FIG. 4 is a cross-sectional diagram of another embodiment of a degradation assembly.

FIG. 4 discloses another embodiment of the present invention wherein the degradation assembly 105 may not comprise the hydraulic reservoir 218. The pick 101 may have a tip 204 comprising a diamond tip bonded to a cemented metal carbide substrate at a non-planar interface, a body 400 comprising a cemented metal carbide portion 401 and a steel portion 402, and a shank 221.

Figure 5:
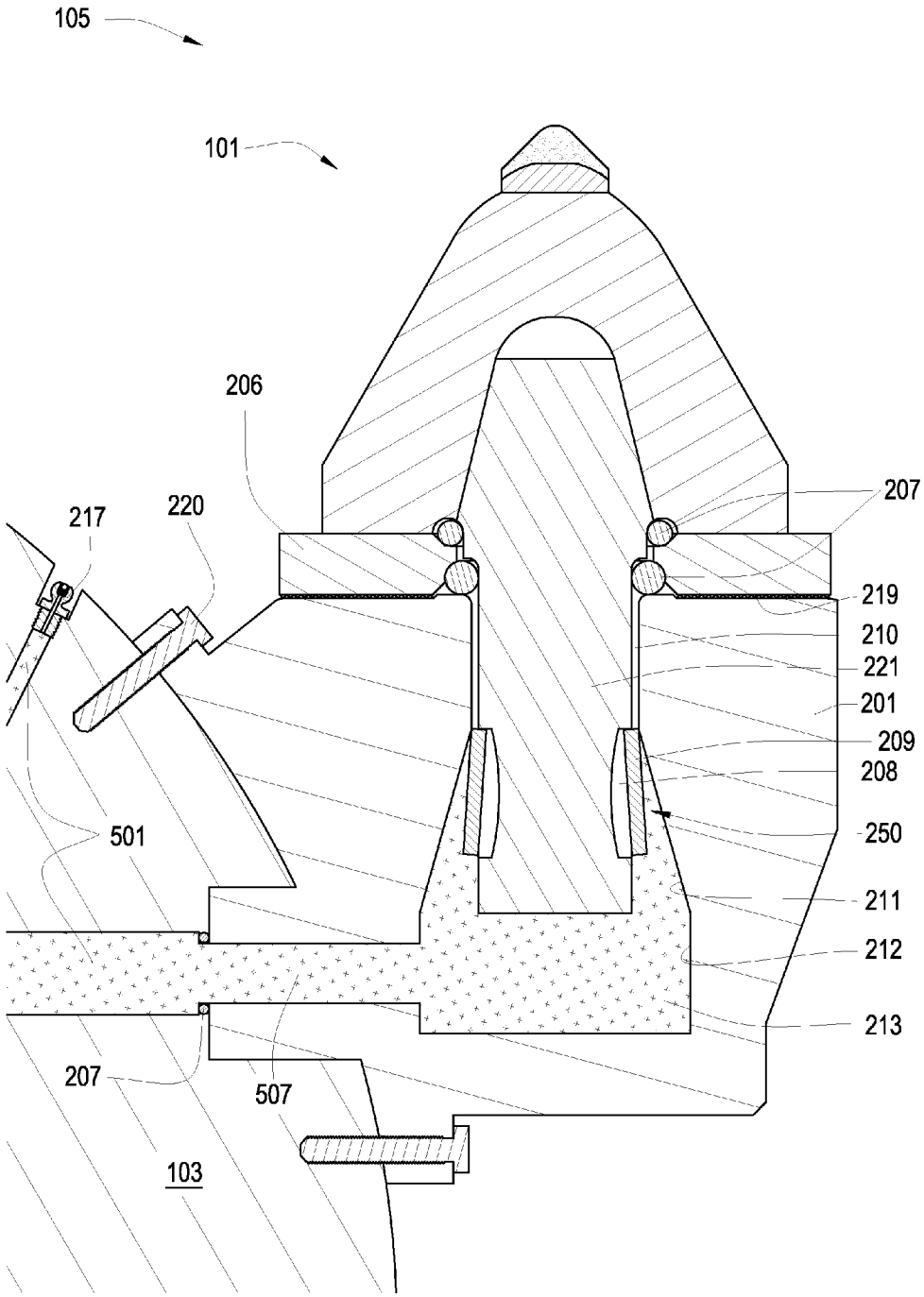
FIG. 5 is a cross-sectional diagram of another embodiment of a degradation assembly.

Referring to FIG. 5, the holder 102 may comprise a block 201. A lubricant reservoir 213 is disposed with in the block 201 and provides lubricant to the shank 221. The lubricant reservoir 213 may be connected to a fluid reservoir 501 disposed in the drum 103 by a channel 507. The fluid reservoir 501 may supply the lubricant reservoir 213 with additional lubricant. Additional lubricant may be added to the fluid reservoir 501 through a filling port 217. The shank 221 may be removed partially or completely from the bore 210 hydraulically by adding additional lubricant to the fluid reservoir 501 and lubricant reservoir 213 till the inside pressure compresses the spring 209 and forces the shank 221 outward.

Figure 5A:
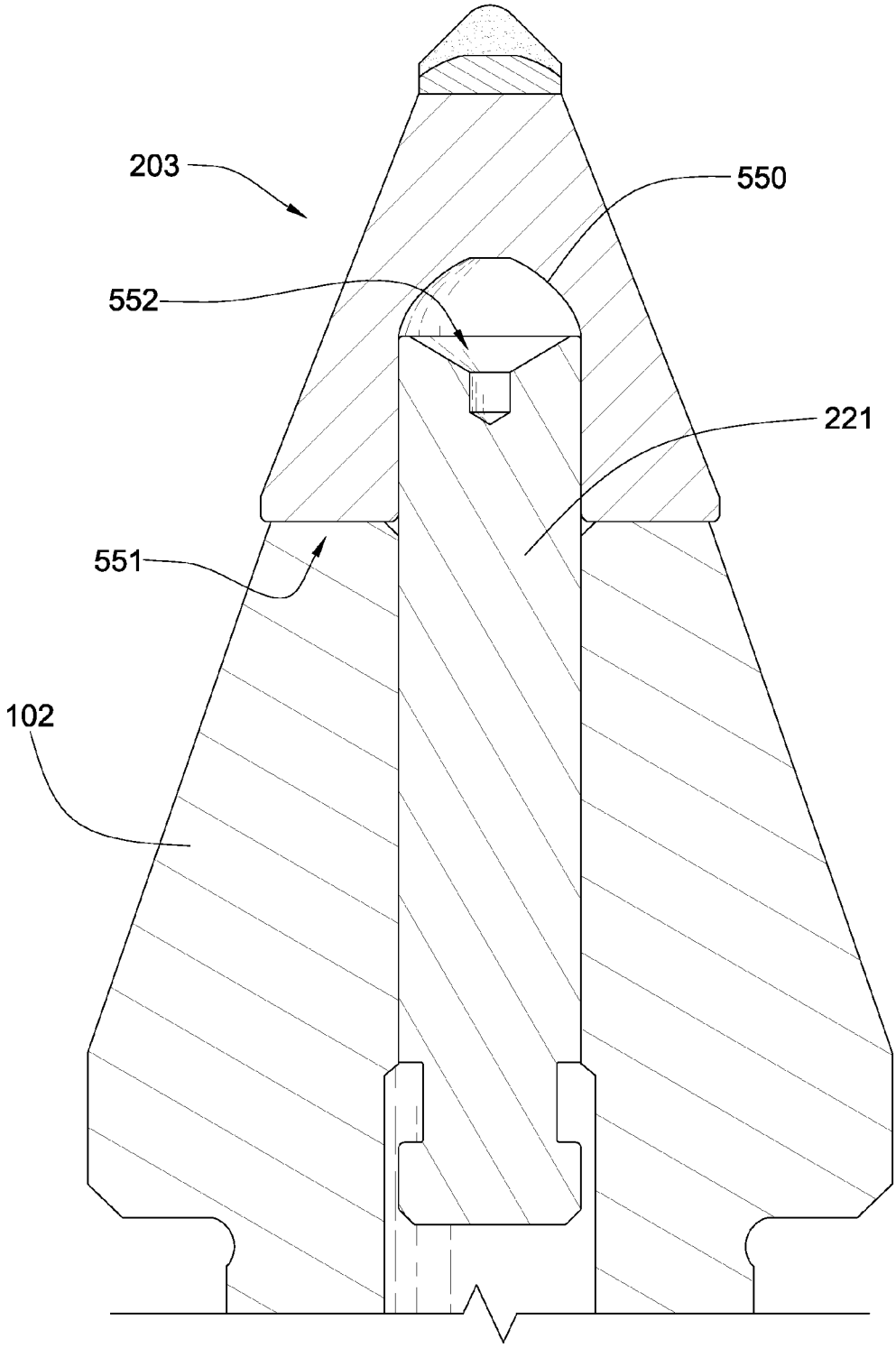
FIG. 5*a* is a cross-sectional diagram of another embodiment of a degradation assembly.

FIG. 5*a* discloses a steel shank 221 fit into a pocket 550 formed in the bottom side 551 of a carbide bolster 203. The shank 221 in the pocket 550 comprises at least one compliancy groove 552. The carbide bolster 203 contacts the holder 102 directly.

Figure 6:
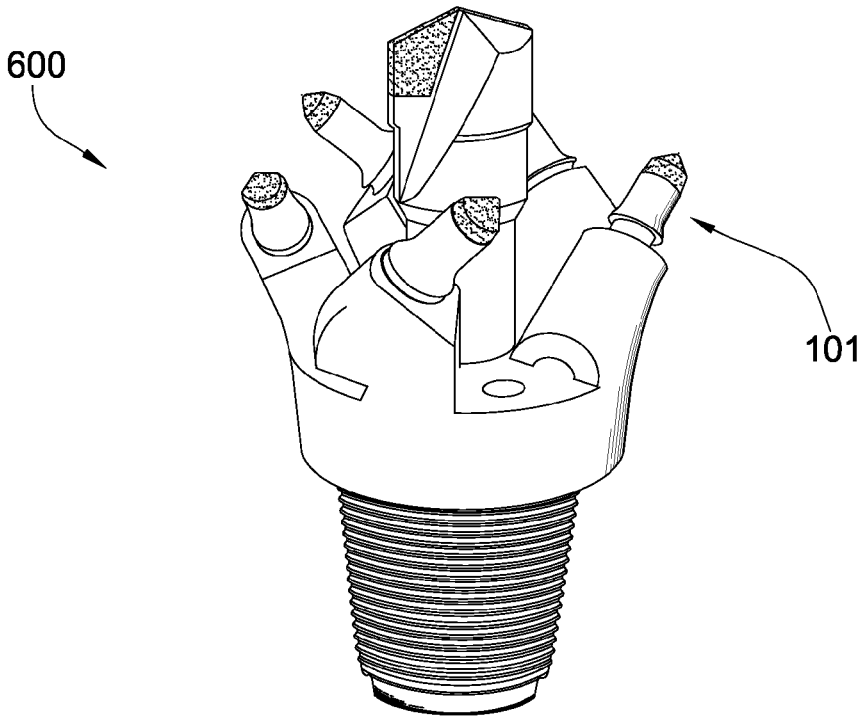
FIG. 6 is an orthogonal diagram of an embodiment of a drill bit.
Figure 7:
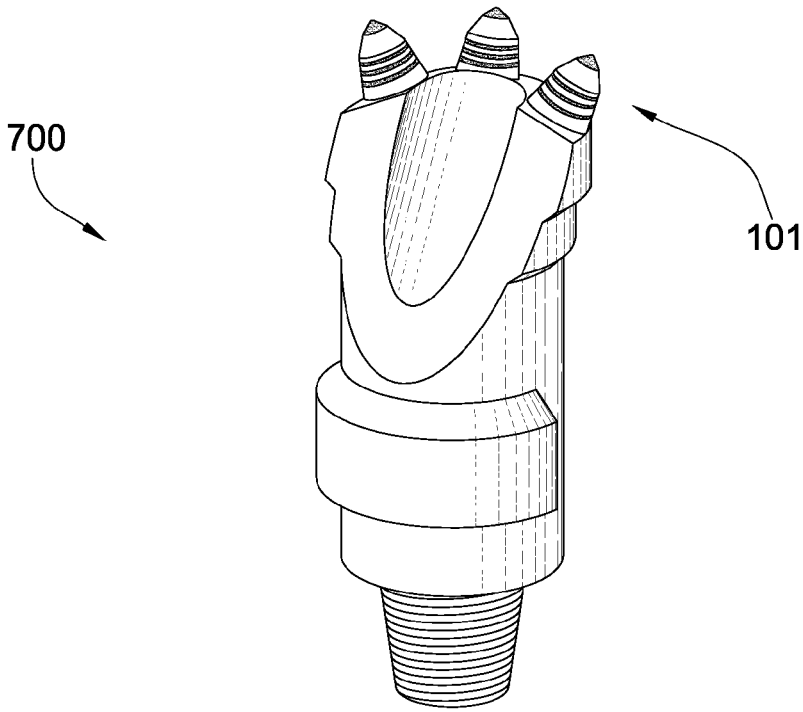
FIG. 7 is an orthogonal diagram of another embodiment of a drill bit.

Degradation assemblies 105 may be used in various applications. FIGS. 6 through 7 disclose various wear applications that may be incorporated with the present invention. FIG. 6 discloses a drill bit 600 typically used in water well drilling. FIG. 7 discloses a drill bit 700 typically used in subterranean, horizontal drilling. These bits 600, 700, and other bits, may be consistent with the present invention.

Figure 8:
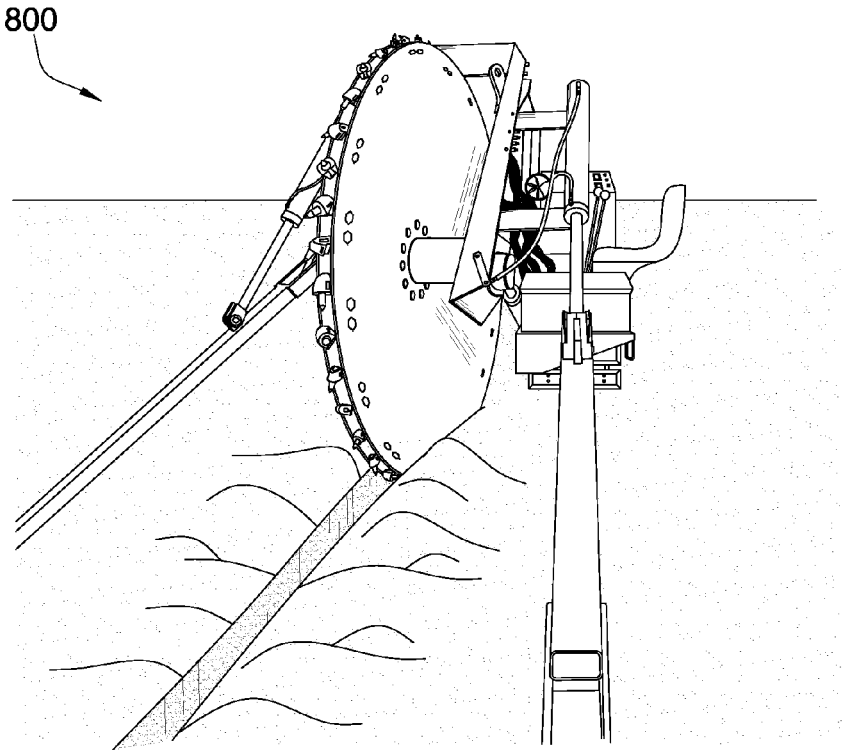
FIG. 8 is a perspective diagram of an embodiment of a trencher.
Figure 9:
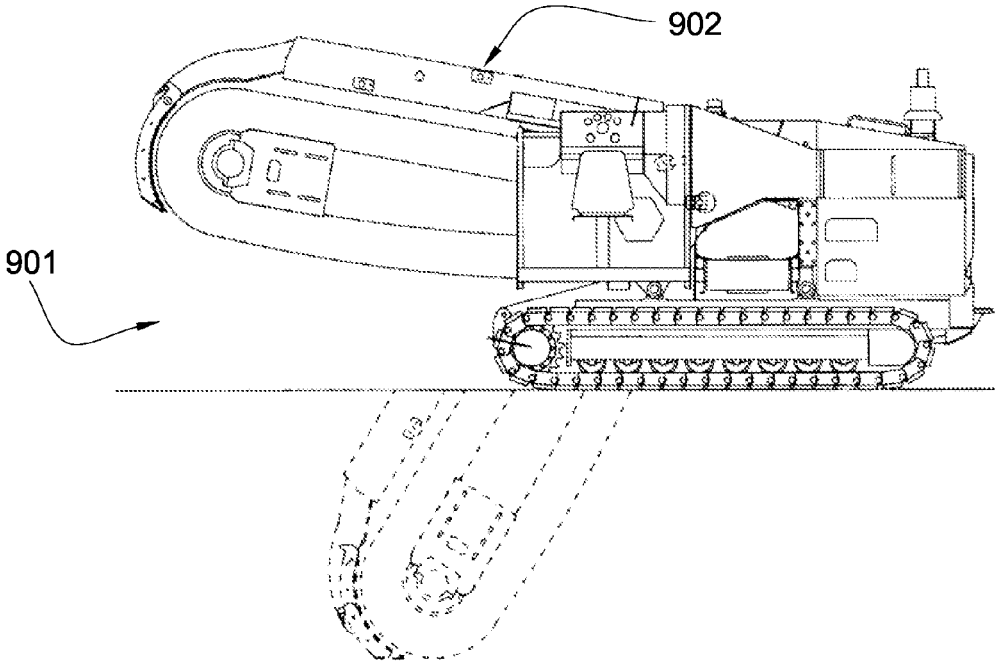
FIG. 9 is an orthogonal diagram of another embodiment of a trencher.

The degradation assembly 105 may be used in a trenching machine, as disclosed in FIGS. 8 through 9. Degradation assemblies 105 may be disposed on a rock wheel trenching machine 800 as disclosed in FIG. 8. Referring to FIG. 9, the degradation assembly may be placed on a chain that rotates around an arm 902 of a chain trenching machine 901.

Figure 10:
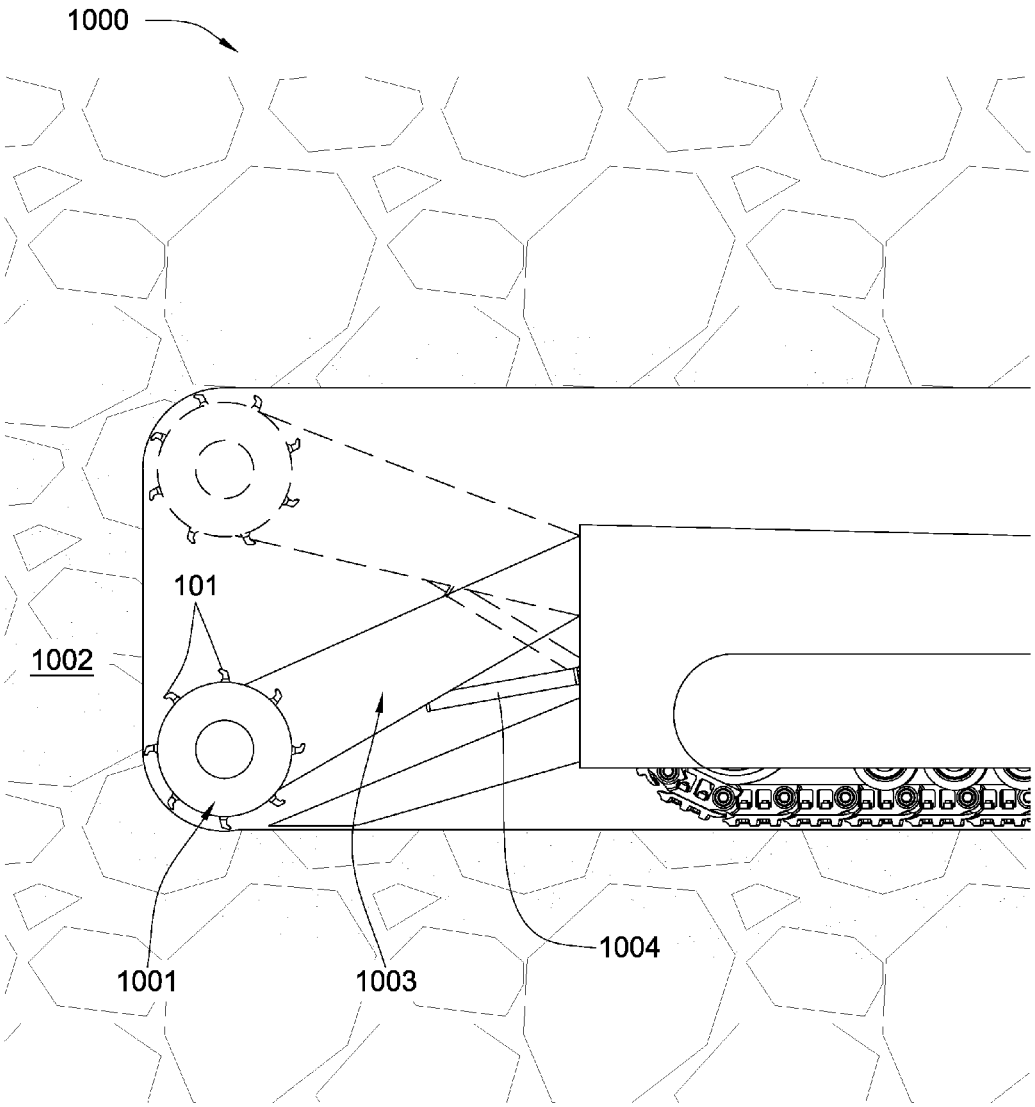
FIG. 10 is an orthogonal diagram of an embodiment of a coal trencher.

FIG. 10 is an orthogonal diagram of an embodiment of a coal trencher 1000. At least one degradation assembly 105 is connected to a rotating drum 1001 that is degrading coal 1002. The rotating drum is connected to an arm 1003 that moves the drum vertically in order to engage the coal 1002. The arm 1003 may move by that of a hydraulic arm 1004, it may also pivot about an axis or a combination thereof. The coal trencher 1000 may move about by tracks, wheels, or a combination thereof. The coal trencher 1000 may also move about in a subterranean formation. The coal trencher 1000 may be in a rectangular shape providing for easy mobility about the formation.

Other applications that involve intense wear of machinery may also be benefited by incorporation of the present invention. Milling machines, for example, may experience wear as they are used to reduce the size of material such as rocks, grain, trash, natural resources, chalk, wood, tires, metal, cars, tables, couches, coal, minerals, chemicals, or other natural resources.

Whereas the present invention has been described in particular relation to the drawings attached hereto, it should be understood that other and further modifications apart from those shown or suggested herein, may be made within the scope and spirit of the present invention.

What is claimed is:

1. A degradation assembly, comprising:

a holder attached to a driving mechanism and comprising a longitudinal central bore;

the bore comprising an opening at a distal end from the driving mechanism;

a pick comprising a body intermediate a shank and an impact tip, the shank being disposed in the central bore of the holder and the body extending from the opening of the bore; and a tensioning mechanism disposed within the bore and adapted to put the shank in axial tension such that the pick is pulled against an extension of the holder forming a connection therebetween, which is maintained through the axial tension of the tensioning mechanism;

wherein a seal assembly is proximate the opening and disposed intermediate the pick and the holder.

2. The degradation assembly of claim 1, wherein a portion of the central bore has an expanded diameter.

3. The degradation assembly of claim 2, wherein a tapered portion of the central bore intermediate the opening and the expanded diameter portion tapers out from a center axis of the bore towards the expanded diameter portion.

4. The degradation assembly of claim 1, wherein a reduced diameter portion of the shank is disposed intermediate the pick body and a bottom end of the shank.

5. The degradation assembly of claim 4, wherein the tensional mechanism comprises a spring disposed around the reduced diameter portion.

6. The degradation assembly of claim 5, wherein the spring engages a tapered portion inducing axial tension in the shank.

7. The degradation assembly of claim 1, wherein a washer is disposed intermediate the body and the holder.

8. The degradation assembly of claim 1, wherein the holder has a knurled interface that engages a washer disposed intermediate the body and the holder thus preventing the washer to rotate about a center axis of the shank.

9. The degradation assembly of claim 1, wherein the pick adapted to rotate about its central axis.

10. The degradation assembly of claim 1, wherein the body comprises a conical carbide bolster with a recess formed in the end of the bolster opposing the tip of the pick.

11. The degradation assembly of claim 10, wherein the shank has an end adapted to fit in a tapered recess.

12. The degradation assembly of claim 1, wherein the holder comprises a lubricant reservoir adapted to apply a lubricant to the shank.

13. The degradation assembly of claim 12, wherein the lubricant reservoir is pressurized.

14. The degradation assembly of claim 12, wherein the lubricant reservoir comprises a filling port.

15. The degradation assembly of claim 12, wherein the lubricant reservoir is adapted to hydraulically disassemble the degradation assembly.

16. The degradation assembly of claim 12, wherein the lubricant reservoir is disposed within the driving mechanism.

17. The degradation assembly of claim 1, wherein the seal assembly comprises an o-ring partially disposed in a reentrant proximate a junction of the shank and the body.

18. The degradation assembly of claim 1, wherein the seal assembly comprises an o-ring disposed at the distal end of the holder and controls the movement of a lubricant.

19. The degradation assembly of claim 1, wherein the degradation assembly is part of an asphalt milling machine, a trenching machine, a coal mining machine, or combinations thereof.

* * * * *